US005316692A

United States Patent [19]

John

[11] Patent Number: 5,316,692

[45] Date of Patent: May 31, 1994

[54] SILICONE CONTAINING HARD SURFACE SCOURING CLEANSERS

[75] Inventor: Vivian B. John, Sully, Wales

[73] Assignee: Dow Corning Limited, Barry, Wales

[21] Appl. No.: 878,600

[22] Filed: May 5, 1992

[30] Foreign Application Priority Data

Jun. 13, 1991 [GB] United Kingdom ..... 9112748
Oct. 10, 1991 [GB] United Kingdom ..... 9121488

[51] Int. Cl.[5] ..... C11D 1/03; C11D 1/66

[52] U.S. Cl. ..... 252/174.15; 252/174; 252/173; 252/DIG. 14; 252/174.14

[58] Field of Search ..... 252/174.15, 174.14, 252/173, 174, DIG. 14

[56] References Cited

U.S. PATENT DOCUMENTS

| | | | |
|---|---|---|---|
| 2,804,440 | 8/1957 | Brown | 260/28 |
| 4,124,523 | 7/1978 | Johnson | 252/145 |
| 4,511,489 | 4/1985 | Requejo et al. | 252/172 |
| 4,665,116 | 5/1987 | Kornhaber et al. | 524/268 |
| 4,689,168 | 8/1987 | Requejo | 252/139 |
| 4,810,407 | 3/1989 | Sandvick | 252/90 |
| 4,859,359 | 8/1989 | De Matteo et al. | 252/174.15 |
| 4,960,533 | 10/1990 | Wisniewski et al. | 252/142 |
| 5,057,240 | 10/1991 | Madore et al. | 252/174.15 |
| 5,080,824 | 1/1992 | Bindl | 252/174.15 |
| 5,091,105 | 2/1992 | Madore et al. | 252/174 |

FOREIGN PATENT DOCUMENTS 873230 7/1961 United Kingdom .

*Primary Examiner*—Paul Lieberman
*Assistant Examiner*—Kery A. Fries
*Attorney, Agent, or Firm*—James L. DeCesare

[57] ABSTRACT

A cleanser composition for hard surfaces, for example baths, tiles, laminated surfaces and the like, which contains at least one surfactant, an abrasive substance, water and an organosiloxane component which comprises both (A) a dimethylsiloxane having from 2 to 10 silicon atoms and (B) a polydiorganosiloxane in which there is present at least one Si-bonded substituent selected from alkyl groups having from 6 to 50 carbon atoms and the styryl group.

8 Claims, No Drawings

SILICONE CONTAINING HARD SURFACE SCOURING CLEANSERS

This invention relates to a hard surface scouring cleanser composition having as ingredients thereof at least one surfactant and an abrasive material. The invention is characterised in that there is incorporated in the composition both a dimethylsiloxane and a (higher alkyl) methyl siloxane or a styryl methylsiloxane.

Hard surface household cleansers are well known consumer goods and are marketed under various trade names. These cleansers are typically employed to scrub surfaces in bathtubs, wash basins, toilet bowls and for washing and cleaning tile floors and walls.

While such cleansers are effective for removing grease and other soils from surfaces by a mild scouring and detergency action, they suffer from the disadvantage in that a white film of the abrasive component of the cleanser remains on the surface unless the surface is thoroughly wiped and rinsed. At best this streaking phenomenon is unsightly especially on dark coloured tile and enamel surfaces. An additional disadvantage of such conventional cleansers is that they are compounded primarily to provide a cleaning action rather than a polishing action and hence the conventional cleansers leave behind a surface which often times feels dry and dusty.

There has therefore existed a need for an improved hard surface cleanser which eliminates, or at least reduces the disadvantages discussed hereinabove. This invention resides in the discovery that such an improved cleanser is obtained if there is present therein certain organosiloxanes, namely both a low molecular weight methylsiloxane and a siloxane having methyl substituents and higher alkyl or styryl substituents.

It is well-known to incorporate certain siloxane liquids, particularly polydimethylsiloxane, into various cleaning and/or polishing compositions. Polishes for automobile, furniture and other surfaces and which contain polydimethylsiloxanes are described in, for example, British Patents Nos. 792 647 and 873 230. Polishing compositions for automobile surfaces are also described in U.S. Pat. No. 4,665,116 and comprise (a) a pyrogenic silica, (b) a liquid film-forming agent which may be inter alia an amino-functional dialkylpolysiloxane, (c) a plasticiser for the film-forming agent, (d) a volatile organopolysiloxane and (e) an organic solvent. Cleaner and conditioner compositions comprising polydimethylsiloxane, abrasive, surfactant and water are disclosed in British Patent No. 1 597 047. Said compositions are particularly adapted for removing stains from glass-ceramic surfaces, for example those found on cooking appliances and utensils.

According to the present invention there is provided a hard surface scouring, cleanser composition comprising at least one surfactant, an abrasive substance, an organosiloxane component and water characterised in that the organosiloxane component comprises both (A) a dimethylsiloxane having from 2 to 10 silicon atoms, and (B) a polydiorganosiloxane having at least one unit of the general formula $(CH_3)_nRSiO_{[3-n/2]}$ in which n is 1 or 2 and R represents a hydrocarbon group selected from alkyl groups having from 6 to 50 carbon atoms and the styryl group, any remaining units being those represented by the general formula $(CH_3)_mSiO_{[4-m/2]}$ in which m has a value of 2 or 3.

The invention also includes a method of cleaning a hard surface which comprises applying thereto a composition of the invention.

The dimethylsiloxanes (A) for use in the compositions of this invention have from 2 to 10 silicon atoms in the molecule and may be linear or cyclic in structure. Thus they include cyclic siloxanes of the formula $(Me_2SiO)_a$ wherein a has a value of from 3 to 10, and Me represents methyl, and linear siloxanes of the formula $Me(Me_2SiO)_bSiMe_3$ wherein b has a value of from 1 to 9 and Me is as defined above. Specific examples of dimethylsiloxanes (A) are hexamethylcyclotrisiloxane, octamethylcyclotetrasiloxane, decamethylcyclopentasiloxane, hexamethyldisiloxane and octamethyltrisiloxane. The dimethylsiloxanes may be employed as the pure compounds or as mixtures of two or more such compounds having differing values of a and b. Cyclic siloxanes wherein a is 3 are preferably employed as mixtures with cyclic siloxanes having higher a values. Generally preferred as dimethylsiloxanes (A) are octamethylcyclotetrasiloxane, decamethylcyclopentasiloxane, hexamethyldisiloxane and mixtures thereof. Dimethylsiloxanes (A) are commercially available and well-known in the art, as are methods for their preparation.

Polydiorganosiloxanes (B) which form part of the organosiloxane component of the compositions of this invention are linear or substantially linear organosiloxane polymers wherein at least one silicon atom has bonded thereto a higher alkyl group or a styryl group. They may vary in consistency from flowable liquids to greasy solids depending on their molecular weight and the relative proportion of higher alkyl and/or styryl groups present in the molecule. The polydiorganosiloxanes (B) contain at least one unit of formula $(CH_3)RSiO$ (n=1) or $(CH_3)_2RSiO_{\frac{1}{2}}$ (n=2) the remaining units being one or both of $(CH_3)_3SiO_{\frac{1}{2}}$ and $(CH_3)_2SiO$. The substituent R may be styryl or, more preferably, a branched or unbranched alkyl group having from 6 to 50 carbon atoms, for example hexyl, 2-ethylhexyl, trimethylpentyl, nonyl, dodecyl, octadecyl, eicosyl, tricosyl, triacontyl and tetracontyl. Preferred as R groups are those having from 12 to 20 carbon atoms. The R groups may be present attached to terminal silicon atoms or to silicon atoms in non-terminal positions in the polymer chain or in both. Examples of operative polydiorganosiloxanes (B) are, therefore, poly(methyl)dodecylsiloxanes, copolymers of trimethylsiloxane and methyl(octyl)siloxane units, copolymers of trimethylsiloxane, methyl(ocatadecyl) siloxane and dimethylsiloxane units, copolymers of methyl(eicosyl)siloxane and dimethylsiloxane units and copolymers of dimethyl(dodecyl)siloxane, dimethylsiloxane and methyl(dodecyl)siloxane units.

The molecular size and physical consistency of polydiorganosiloxanes (B) may vary widely. However, the preferred polydiorganosiloxanes are those having the formula $(CH_3)_3SiO\ [CH_3(R)SiO]_x[(CH_3)_2SiO]_ySi(CH_3)_3$ in which R is as hereinabove defined and preferably has from 12 to 20 carbon atoms, x is an integer of from 1 to 300, preferably from 1 to 50 and y is zero or an integer of from 1 to 50. Most preferably the sum of x and y is at least 20. Polydiorganosiloxanes of the kind defined for (B) are, in general, known materials and some are available commercially.

The organosiloxane component may be present in an amount of up to 10% by weight based on the total weight of the composition. From considerations of cost, however, this component is preferably employed in an amount of from 0.5 to 5 percent by weight based on the total composition weight. The ratio of dimethylsiloxane (A) to polydiorganosiloxane (B) is not narrowly critical and may vary from 5:1 to 1:1, preferably from 4:1 to 10:1.

A hard surface scouring cleanser composition in accordance with the present invention typically has as its essential ingredients at least one surfactant, water, an abrasive material and an organosiloxane component as described hereinabove. Among the surfactants which may be employed are the anionic and nonionic categories of detersive surfactants including mixtures thereof. Preferred among the numerous categories of conventional anionics are the sodium and potassium alkylbenzene sulfonates in which the alkyl group contains from nine to fifteen carbon atoms in straight or branched chain configurations. Especially useful are the linear straight chain alkylbenzene sulphonates in which the average number of carbon atoms in the alkyl group is from about eleven to about thirteen. Other known anionics may also be employed such as ordinary alkali metal soaps, anionic phosphate surfactants and N-alkyl substituted succinimates.

The nonionic surfactant is preferably a water soluble amine oxide representative of which are the $C_{10}$–$C_{18}$ alkyl dimethyl amine oxides and the $C_8$–$C_{12}$ alkoxy ethyl dihydroxy ethyl amine oxides. Other conventional nonionics may also be employed such as the polyethylene oxide condensates of alkyl phenols; the condensation products of aliphatic alcohols with from 1 to 25 moles of ethylene oxide; the condensation products of ethylene oxide with a hydrophobic base formed by the condensation of propylene oxide with propylene glycol; the condensation products of ethylene oxide with the product resulting from the reaction of propylene oxide and ethylenediamine; alkylpolysaccharides and fatty acid amides such as $C_8$–$C_{20}$ ammonia amides, monoethanolamides, diethanolamides and isopropanolamides. Other surfactant categories which may be employed are the amphoteric, zwitterionic and cationic types although the anionics and the nonionics are most preferable as noted above.

The abrasive substances employed in the compositions of this invention may be any of the well-known finely-divided abrasives such as silicon oxide, aluminum oxide, aluminum hydroxide, synthetic and natural zeolites, magnesium oxide, calcium phosphate, calcite, dolomite, glauconite, diatomaceous earth, zirconium oxide and cerium oxide. Preferred are the mildly-abrasive substances consisting of small particles which are easily dispersed in the other ingredients of the composition and which demonstrate a safe and efficient abrasive action on the surface to be cleaned. Examples of such preferred abrasives are calcium carbonate having a particle size of from 1 to 400 microns and diatomaceous earth.

Numerous adjuvant components may be included as ingredients of the hard surface cleansers of the present invention including thickeners, builders, stabilizers, preservatives, disinfectants, perfumes, dyes, buffers and bleach active compounds. These adjuvants are well known in the art. For example, exemplary of thickeners which may be employed are sodium alignate, gum arabic, guar gum, methyllcellulose, methylhydroxyprpylcellulose, hydroxypropylcellulose polypropylhydroxyethylcellulose, starch, hydroxyethylamylose, starch amylose, locust bean gum, sodium chloride, fructose, glucose, xanthan gum and clays such as smectite, attapulgite, bentonite, montmorillonite and hectorite.

The abrasive, surfactant, water and optional adjuvants may be present in proportions conventional in hard surface cleanser creams. A hard surface cleanser in accordance with the present invention preferably contains 1 to 15 percent by weight of at least one surfactant, 5 to 70 percent by weight of an abrasive, 0.5 to 5 percent by weight of the organosiloxane component, 10 to 60 percent by weight of water and optionally 0.1 to 5 percent by weight of a thickener.

The compositions of this invention may be prepared by any suitable technique, for example by simply mixing the individual ingredients until the desired homogeneity and consistency are obtained. In general, however, it has been found more convenient to premix the surfactant with at least some of the water and to disperse the polydiorganosiloxane (B) in the dimethylsiloxane (A) prior to incorporation with the remaining ingredients.

The following example, in which the parts are expressed by weight and Me=methyl, is set forth in order to illustrate the present invention and to show a method of preparing a hard surface scouring cleanser which is in the form of a cream.

EXAMPLE

Into 43.4 parts of water in a suitable container there was dispersed 0.3 part of a thickener which was sodium magnesium silicate and 0.4 part of a second thickener which was xanthan gum. Fifty parts calcium carbonate in particulate form were added to the container and the mixture stirred until homogeneous. Five parts of a forty percent aqueous solution of an anionic surfactant which was sodium dodecylbenzene sulphonate was then added and the contents of the container again stirred until homogeneous. Formulations "A", "B", "C" and "D" as shown in Table I were prepared using portions of the contents of the container and portions of the indicated siloxanes which were employed in Formulations B, C and D in premixed form. A control formulation "E" was used which included a portion of the contents of the container but with no added siloxane. The preparation of formulations "A" and "B" required only simple mixing of the silicones with the container contents. Formulations "C" and "D" required in addition gentle heating.

TABLE I

| Ingredients | Formulation in Parts by Weight | | | | |
|---|---|---|---|---|---|
| | A | B | C | D | E |
| Contents of Ex. I | 95.0 | 95.0 | 95.0 | 95.0 | 95.0 |
| Cyclic siloxane | 5.0 | 4.0 | 4.0 | 4.0 | — |
| Alkylmethyl I | — | 1.0 | — | — | — |
| Alkylmethyl II | — | — | 1.0 | — | — |
| Alkylmethyl III | — | — | — | 1.0 | — |

Cyclic siloxane = $(Me_2SiO)_4$
I = $Me_3SiO(Me_2SiO)_3[(MeSiO(CH_2)_{11}CH_3)]_5SiMe_3$
II = $Me_3SiO(Me_2SiO)_3[(MeSiO(CH_2)_{17}CH_3)]_5SiMe_3$
III = $Me_3SiO(Me_2SiO)_3[(MeSiO(CH_2)_{19}CH_3)]_5SiMe_3$ Equal portions of each of the formulations "A" to "E" were individually tested by being placed on a laminate working surface, rubbed into the test surface with paper towels, allowed to dry and the results were noted for each formulation. The test surfaces treated with each formulation were rinsed with lukewarm water using a paper towel and the results were recorded. Table II reflects these results noting both the pre-rinse data and the rinsed data for each of the formulations tested.

TABLE II

| Formulation | Streaking | Texture | Gloss |
|---|---|---|---|
| | Pre-Rinsed | | |
| A | better | neutral | neutral |
| B | none | neutral | fair |
| C | none | smooth | glossy |
| D | none | smooth | glossy |
| E | much | gritty | none |
| | Rinsed | | |
| A | better | neutral | neutral |
| B | none | smooth | fair |
| C | none | smooth | good |
| D | none | smooth | good |
| E | much | gritty | none |

As can be seen from Table II, there was a noticeable improvement in surfaces treated with formulations "B", "C" and "D" which contained the mixture of the cyclic siloxane and the alkylmethylsiloxane.

That which is claimed is:

1. A hard surface scouring, cleanser composition comprising at least one surfactant, an abrasive substance, an organosiloxane component and water characterised in that the organosiloxane component comprises both (A) a dimethylsiloxane having from 2 to 10 silicon atoms, and (B) a polydiorganosiloxane having at least one unit of the general formula $(CH_3)_nRSiO_{[3-n/2]}$ in which n is 1 and R represents a hydrocarbon group selected from alkyl groups having from 12 to 20 carbon atoms and the styryl group, any remaining units being those represented by the general formula $(CH_3)_mSiO_{[4-m/2]}$ in which m has a value of 2 or 3.

2. A cleanser composition as claimed in claim 1 characterised in that polydiorganosiloxane (B) has the general formula $(CH_3)_3SiO\ [CH_3(R)SiO]_x[(CH_3)_2SiO]_ySi(CH_3)_3$ in which R is as defined in claim 1, x is an integer of from 1 to 300, y is an integer of from 1 to 50 and the sum of x+y is at least 20.

3. A cleanser composition as claimed in claim 2 characterised in that x is an integer of from 1 to 50.

4. A composition as claimed in claim 1 characterised in that the dimethylsiloxane (A) is selected from octamethylcyclotetrasiloxane, decamethylcyclopentasiloxane, hexamethyldisiloxane and mixtures thereof.

5. A cleanser composition as claimed in claim 1 characterised in that the abrasive is selected from particulate calcium carbonate and diatomaceous earth.

6. A cleanser composition as claimed in claim 1 characterised in that the dimethylsiloxane (A) and polydiorganosiloxane (B) are present in the composition in a weight ratio of from 4:1 to 10:1.

7. A cleanser composition as claimed in claim 1 characterised in that it comprises by weight from 1 to 15 percent of surfactant, 5 to 70 percent of abrasive, 0.5 to 5 percent of the organosiloxane component, 10 to 60 percent of water and 0.1 to 5 percent of a thickener.

8. A method of cleaning hard surfaces which comprises applying thereto a cleanser composition as claimed in claim 1.

* * * * *